367-93 SR

12/30/80 OR 4,242,743

United States Patent [19]

Salem

[11] 4,242,743

[45] Dec. 30, 1980

[54] INTRUSION DETECTION METHOD AND APPARATUS

[75] Inventor: Robert J. Salem, Danbury, Conn.

[73] Assignee: General Electric Company, New York, N.Y.

[21] Appl. No.: 959,236

[22] Filed: Nov. 9, 1978

[51] Int. Cl.[3] ..... G08B 13/16

[52] U.S. Cl. ..... 367/93

[58] Field of Search ..... 340/558, 559, 552, 553, 340/1 R, 1 C; 343/5 PD; 367/93, 94

[56] References Cited

U.S. PATENT DOCUMENTS

| | | | |
|---|---|---|---|
| 3,562,703 | 2/1971 | Grada | 340/1C |
| 3,686,658 | 8/1972 | Wilt | 340/16 R |
| 3,713,126 | 1/1973 | Stettner | 340/527 |
| 3,739,325 | 6/1973 | Ludwig | 340/1 R |
| 4,016,529 | 4/1977 | Inuzuka et al. | 340/1 R |

*Primary Examiner*—David L. Trafton

*Attorney, Agent, or Firm*—Carlos Nieves; John F. Cullen; Leonard J. Platt

[57] ABSTRACT

A pulse echo intrusion detection method and apparatus is described wherein a reference parameter is automatically established which is representative of an interval of time elapsed during initial projection and reflection of pulse energy between a source and a receiver. The reference parameter is periodically compared with successive pulse projection and reflection time measurements in order to sense variations indicative of a changed environment such as might be caused by the presence of an intruding object.

14 Claims, 7 Drawing Figures

INTRUSION DETECTION METHOD AND APPARATUS

BACKGROUND OF THE INVENTION

1. Field of the Invention

This invention relates to intrusion alarms. The invention relates more particularly to an improved ultrasonic method and apparatus for detecting the presence of an intruder in a protected space or certain other environmental changes.

2. Description of the Prior Art

Intrusion alarms have been utilized for detecting the presence of an intruder in a protected area. In a known intrusion alarm system employing Doppler principles, a transmitter and receiver are located in, or adjacent to, an area to be protected and a continuous wave of ultrasonic energy is broadcast by the transmitter at a predetermined frequency. Acoustical energy at the same frequency is reflected by stationary objects in the protected area and is sensed by the receiver. Insofar as the reflected energy occurs at the same frequency, the apparatus determines that an intruding condition does not exist and no alarm is sounded. The passage or movement of an intruder through the protected area, however, causes a variation in the frequency of the reflected energy which variation is sensed and an alarm is sounded.

This form of intrusion alarm system is recognized to be substantially susceptible to false alarms. Any movement in the protected area will cause a frequency shift causing a false alarm. The movement can be caused, for example, by the fluttering of a window curtain, the passage of a pet through a room and such other movements as can normally be expected to occur. Such false alarms are of course undesirable and reduce the reliability and value of the system.

An alternative pulse-echo technique for object detection is known wherein a pulse of acoustical energy is projected from a transducer and the occurrence of a reflected pulse within a predetermined time interval is indicative of the presence of an object in an area being examined. Prior pulse-echo object detecting apparatus, however, have been relatively complex and costly and do not readily lend themselves to use as intrusion alarm detectors.

SUMMARY OF THE INVENTION

Accordingly, it is the principal object of the present invention to provide an improved method and apparatus for detecting the occurrence of intruding objects in a protected area.

Another object of the invention is to provide an improved intrusion detection apparatus which is substantially reliable and not susceptible to false alarms.

Another object of the invention is to provide an intrusion alarm apparatus which is adapted to discriminate between sizes of intruding objects in a protected area.

Another object of the invention is to provide an intrusion alarm detector of relatively low cost and which lends itself to mass production.

A further object of the invention is to provide an improved pulse-echo type of intrusion detector apparatus.

Another object of the invention is to provide an intrusion detection apparatus which projects pulse energy at a reference surface and which detects the intrusion of an object between the source and the reference surface.

Another object of the invention is to provide an improved pulse type of intrusion detector apparatus which projects energy at a reference surface and which is adapted to automatically accommodate itself to reference surfaces at varying distances from the detector.

Another object of the invention is to provide an improved intrusion detector apparatus having means for delaying the generation of the alarm.

Still another object of the invention is to provide an intrusion detector apparatus having means for initiating the generation of an alarm for a predetermined time and terminating the alarm after the expiration of predetermined time.

Briefly, one aspect of the invention is an improved method for detecting the presence of an intruding object or certain other environmental changes in a protected area. The method comprises the steps of projecting a reference pulse of acoustical energy from a source into an area having at least one reflective surface therein; and establishing a reference parameter ($T_r$) having a magnitude proportional to the interval of time elapsed between projection of said reference pulse and reflection of said reference pulse to a receiver. The method also includes the steps of projecting a similar pulse of acoustical energy from the source into the area, establishing an elapsed time parameter ($T_e$)having a magnitude proportional to the interval of time elapsed between projection of said similar pulse and reflection of said similar pulse to the receiver; comparing the magnitudes of the reference parameter ($T_r$) and the elapsed time parameter ($T_e$) and sensing for a variation ($\Delta T$) therebetween; and generating an alarm in response to a variation ($\Delta T$).

In accordance with more particular features of the method of the invention, an alarm is generated only when the variation ($\Delta T$) exceeds a predetermined magnitude. The alarm is generated for a predetermined interval of time and is terminated upon expiration of the interval. In a preferred embodiment of the invention, the method includes automatically establishing a reference parameter ($T_r$) comprising a digital electrical signal by incrementing a binary counter during an interval of time, transferring a count accumulated by said counter to a storage register, incrementing the binary counter over a successive interval of time and comparing the contents of the counter and the storage register.

Another aspect of the invention is incorporated in the combination of apparatus, comprising: source means for periodically projecting a pulse of acoustical energy into an area having at least one reflective surface therein; and receiver means for sensing reflection of the pulses of acoustical energy. The apparatus also includes sensing and comparison means coupled to the source means and the receiver means for (1) sensing the elapsed time between the projection of each pulse by said source means and reception of the reflection thereof by said receiver means, (2) establishing a reference ($T_r$) having a magnitude proportional to the elapsed time between projection and reception of an initial pulse, (3) comparing the reference parameter ($T_r$) with an elapsed time parameter ($T_e$) having a magnitude proportional to the elapsed time between projection and reception of a subsequent pulse and sensing for a variation ($\Delta T$) therebetween, and (4) producing an output signal in response to a variation ($\Delta T$); and alarm means coupled to said sensing and comparison means for receiving output signals therefrom, said alarm means generating an alarm in response to an output signal from said sensing and comparison means.

In accordance with a further aspect of the invention, common counting means is provided for establishing not only the reference parameter ($T_r$) and the elapsed time intervals ($T_e$), but also for establishing various delay periods useful in the operation of the apparatus. Means are provided for causing the common counting means to increment at a relatively rapid rate during a normal operating mode and at a substantially slower rate during the start-up and alarm modes.

BRIEF DESCRIPTION OF THE DRAWINGS

These and other objects and features of the invention will become apparent with reference to the following specification and to the drawings wherein.

DETAILED DESCRIPTION

Figure 1A:
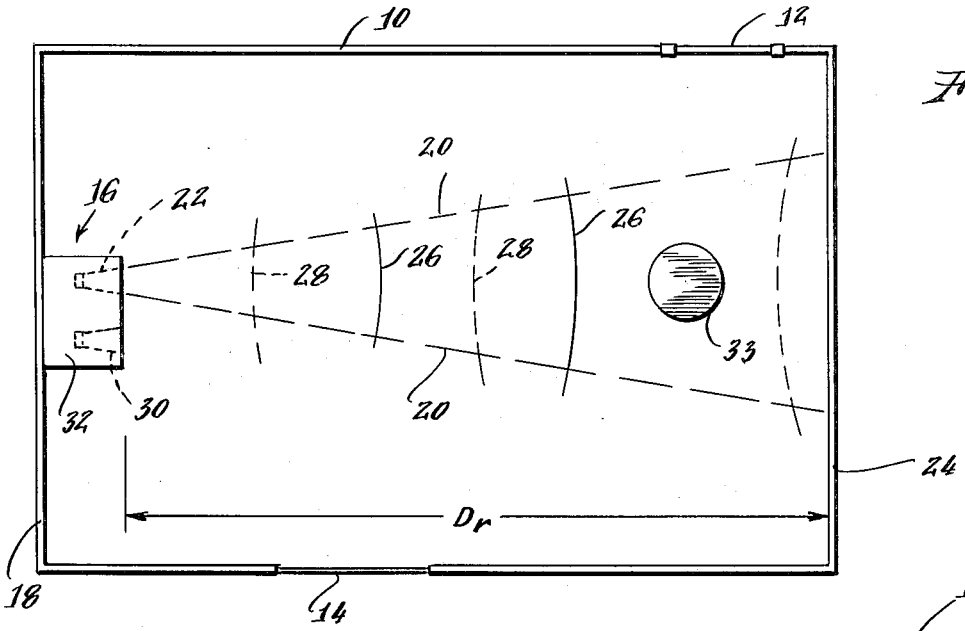
FIG. 1A is a fragmentary, schematic plan view of a room to be protected from intrusion which illustrates the intrusion protection method and apparatus of the invention.

A pulse-echo method and apparatus for establishing intrusion protection is illustrated generally in FIG. 1A, which is a plan view of an area to be protected. The area comprises a room 10, having various means of ingress and egress, such as a door 12 and a window 14. The apparatus of the invention, referenced generally as 16, is shown positioned adjacent a room wall member 18 at a convenient elevation. A generally conically-shaped, relatively narrow beam 20 of acoustical energy is projected from a source means of the apparatus 16. The beam is projected from a transmitting transducer member 22 toward a reference surface comprising a flat surface of an opposite wall 24. The projected acoustical energy, represented by the curved wavefronts 26, impinges upon the flat wall surface and is reflected therefrom. Curves of the wavefront of reflected acoustical energy are represented by the dashed curves 28. The reflected acoustical energy is sensed by a receiver means of the apparatus. Reflected acoustical energy incident on a receiving transducer member 30 causes an electrical signal to be generated which is representative of the received energy. The transmitting and receiving transducers 22 and 30 respectively are shown mounted in juxtaposed relationship in a housing member 32 of the apparatus 16. This transducer arrangement provides a relatively compact and easily positioned intrusion alarm apparatus, which can be fabricated at relatively low cost. Alternatively, the transmitting and receiving transducers can be positioned at spaced apart locations, insofar as the receiver is orientated for receiving reflected energy.

The intrusion detection apparatus 16 operates on the pulse-echo principle wherein pulses of acoustical energy are periodically projected to and reflected from the wall 24. Acoustical energy travels a distance (2 $D_r$) during its projection and reflection between the apparatus 16 and wall 24. A time interval required for the projection and reflection of a pulse over the distance (2 $D_r$) is referred to as the reference parameter or time ($T_r$). As described in more detail hereinafter, the apparatus 16 initially automatically generates and stores an electrical signal which is representative of the reference time ($T_r$). The apparatus 16 then periodically projects pulses of energy, compares the elapsed time ($T_e$) of projection and reflection with the stored reference time ($T_r$), and senses any deviations therefrom. The presence or the transit of an intruding body 33 in or adjacent to the beam 20 causes the elapsed time ($T_e$) to differ from the reference time ($T_r$) by some time differential ($\Delta T$). When a ($\Delta T$) occurs [preferably a ($\Delta T$) exceeding a predetermined magnitude], the apparatus 16 immediately, or after a predetermined delay, sounds an alarm indicating the ocurrence of an intrusion.

Figure 1B:
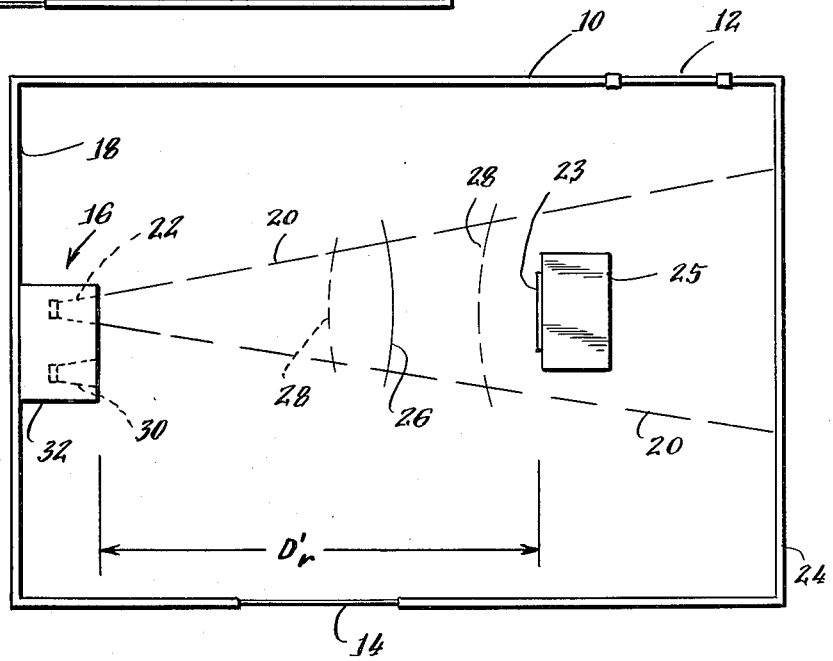
FIG. 1B is a view similar to FIG. 1A showing a modified room arrangement.
Figure 2:
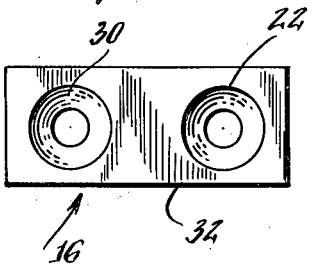
FIG. 2 is an enlarged, side elevation view of an intrusion apparatus of the present invention.

One advantageous feature of the apparatus 16 is its discrimination characteristic with respect to the size and shape of objects. Within its range the apparatus 16 readily senses reflections from flat surfaces oriented normal to the beam 20 such as the wall 24. The wall member 24, is a preferred reference target, since its relatively large flat surface enables all of, or a substantial part of the cross-section of the beam 20 to impinge upon the surface and to efficiently reflect acoustical energy toward the receiving transducer. Flat reference surfaces provide relatively high reflection characteristics whereas relatively smaller objects do not substantially reflect or interfere with reflected energy from the reference surface. Curved surfaces exhibit similar characteristics. The apparatus is therefore advantageously insensitive to non-intruding motions which might trigger false alarms. Such motion can include the movement of a pet animal through the protected area, the fluttering of a window curtain, etc. On the other hand, the presence or transit of relatively larger bodies in the protected area, such as an adult body 33 in FIG. 1 while not reflecting sufficient energy to be sensed by the apparatus will significantly interfere with and attenuate the reflection of energy from the reference surface 24.

When reflection of energy from the reference surface is attenuated, the elapsed time ($T_e$) of the projected and reflected pulse will therefore differ from the reference time ($T_r$) and will be effectively larger. The apparatus 16 senses a ($\Delta T$) and indicates the occurrence of an intrusion. In a similar manner, the positioning or the movement of a relatively large flat planar object in the protected area after the apparatus 16 is placed into the operation will cause a premature reflection of the projected energy; the interval of time ($T_e$) will be less than ($T_r$); a ($\Delta T$) will occur; and, an alarm will be sounded.

Other relatively flat planar reference surfaces, but of substantially lesser size than the wall 24, can also be utilized as reference targets. As illustrated by FIG. 1B, the room 10 is again illustrated, but in this case, the projected acoustical energy impinges principally upon a relatively flat reflective surface 23 of a piece of furniture 25 such as a bureau or a TV set. The extent to which the cross-sectional segment of the beam impinges on the reflective surface is dependent upon the size of the surface, the distance ($D'_r$) between the apparatus and the reflective reference surface, movement if any of the surface, and the presence of interfering objects between the surface and the apparatus. In this case, the reference parameter ($T_r$) is the time required for the projection and reflection of a pulse over the distance (2 $D_r'$). If, for some reason, the piece of furniture 25 were subsequently moved out of the beam in some manner, the elapsed time ($T_e$) of subsequent pulses will differ from the reference time ($T_r$), and the alarm will be sounded. In this regard, it should be noted that, in accordance with the invention, an alarm will be generated when a change in the environment occurs even though a pulse of acoustical energy has not been interfered with by a separate object or intruder entering the path of the beam. In this case, wherein the initial target surface of object 25 is withdrawn from impingement by the beam, the alarm will sound even though the beam is reflecting off the wall surface 24 and the alarm condition in this case is identical to the reference condition illustrated in FIG. 1A. Similarly, the beam can be directed toward other objects such as a door or window, in which case the alarm would sound if the door or window were opened. The intrusion alarm of this invention senses certain significant environmental changes occurring after the establishment of the reference parameter ($T_r$).

Figure 4:
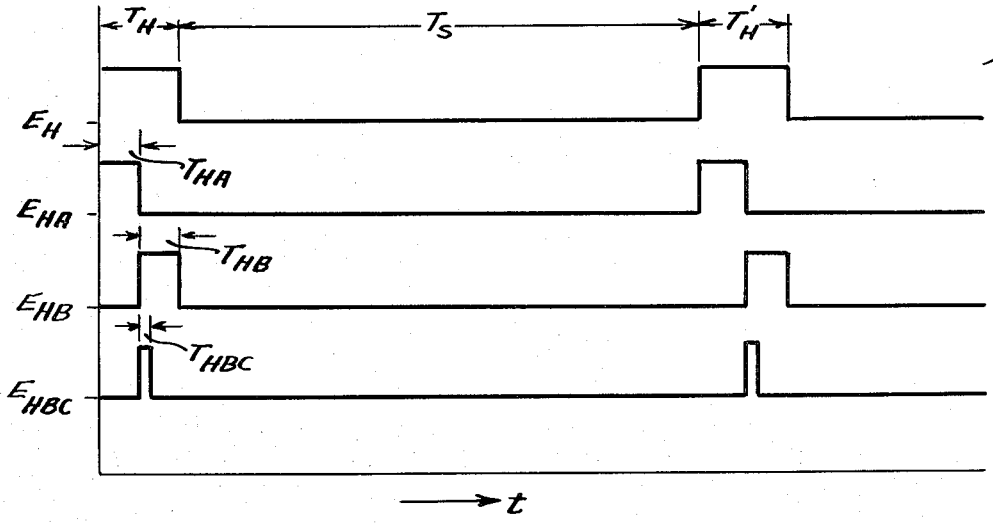
FIG. 4 is a timing diagram illustrating the various signals occurring in the apparatus of FIG. 3.
Figure 3:
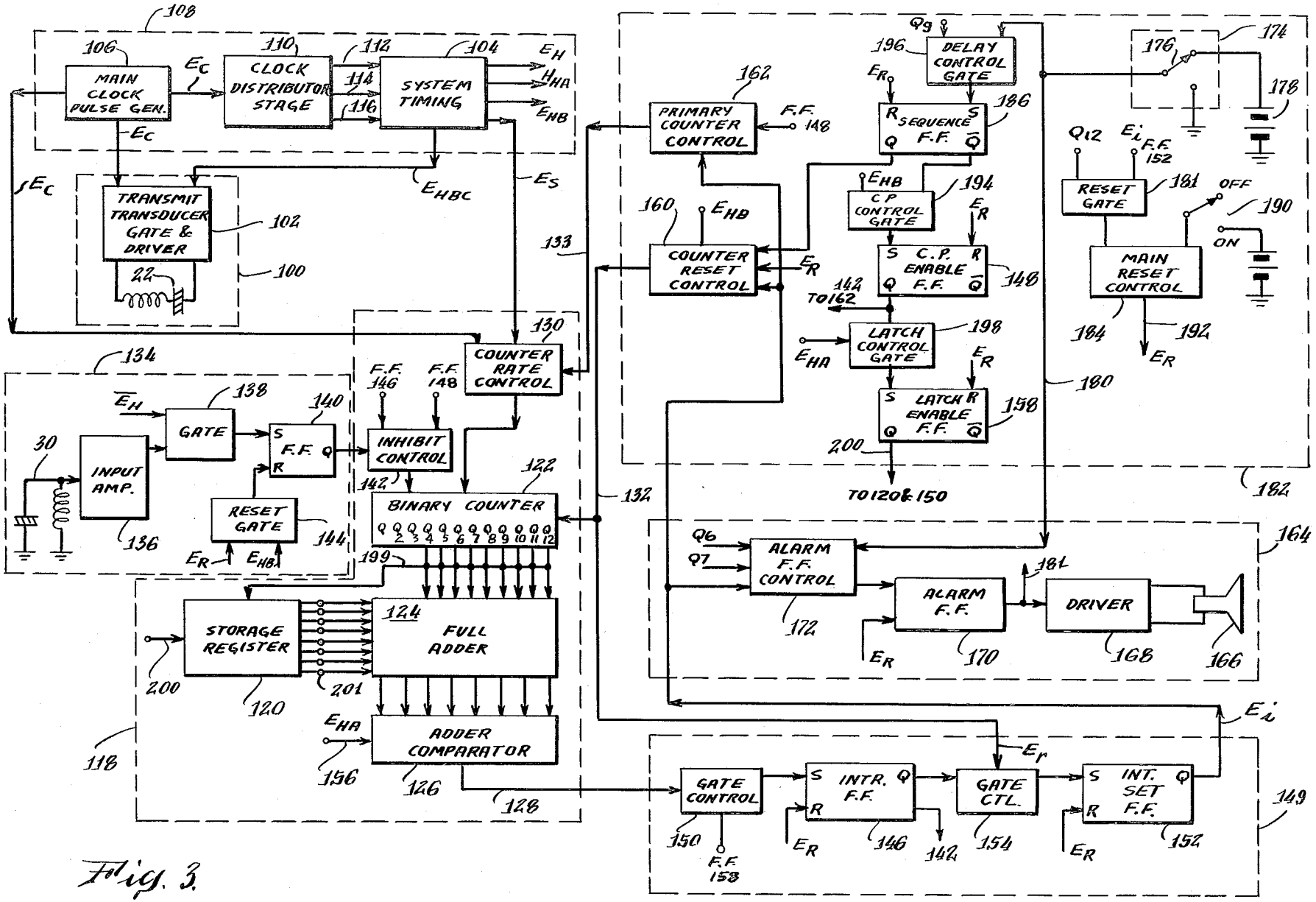
FIG. 3 is a block diagram illustrating the apparatus of the present invention.

The arrangement of the apparatus 16 is illustrated in the block diagram of FIG. 3. An acoustical output pulse source means comprises a transmitter stage 100 which, as shown within the dashed rectangle, includes an electrical-to-acoustical transducer 22. The transducer 22 is represented symbolically in FIG. 3 by the equivalent circuit of an inductance and a crystal. When periodically excited by a pulse of electrical energy, the transducer 22 periodically emits a pulse of acoustical energy. The transducer 22 is energized by a driver and a gating means 102. Input signals to the driver and gating means 102 comprise a gating signal ($E_{HBC}$), derived from a system timing means 104 and a main clock signal ($E_c$), derived from a main clock oscillator 106. The gating signal ($E_{HBC}$), which occurs periodically at a predetermined pulse repetition rate PRR has a pulse width ($T_{HBC}$), as shown in FIG. 4. During the pulse interval ($T_{HBC}$), the driver and gating means 102 is enabled and the transducer is excited by the clock signal ($E_c$) at the main clock oscillator frequency ($f_c$).

For a predetermined pulse rate PRR, the apparatus 16 will have a maximum range ($D_m$). Projection of acoustical energy beyond this range can result in an undesirable overlapping between the transmitted and received pulses. In an exemplary application the maximum range ($D_m$) is 30 feet and the pulse repetition rate is on the order of 12 Hz. The main clock oscillator 106 generates a clock signal at an ultra-sonic frequency ($f_c$) thereby rendering inaudible the projected acoustical pulses.

A timing means for generating a plurality of timing pulses for timing the various operations of the apparatus is illustrated within the rectangle 108 and is shown to include the main clock oscillator 106, a clock divider stage 110 and the system timing stage 104. The clock signal ($E_c$) is applied to the clock divider state 110. The clock divider stage steps down the ultra-sonic clock frequency and generates outputs on lines 112, 114, and 116, which are coupled to the system timing stage 104. The system timing output signals ($E_H$), ($E_{HA}$), ($E_{HB}$) and ($E_{HBC}$) control the timing and operation of various components of the apparatus. These signals and their timing relationship are illustrated in FIG. 4. In addition to these timing signals, a relatively low frequency counter-stepping signal, ($E_s$) is provided as an output signal from the system timing 104.

A reference and an elapsed time sensing and comparison means is provided and is shown within the dashed rectangle 118. This means includes a storage means comprising a storage register 120 in which a digital signal representative of the reference time ($T_r$) is entered and stored, a counter means comprising a binary counter 122 which is stepped at the clock rate ($f_c$) to periodically provide a digital output signal representative of the elapsed time ($T_e$) and means comprising an adder 124 and comparator 126 for detecting a variation between ($T_r$) and ($T_e$). As described hereinafter, the counter means 122 further serves as a delay timer during an initiate mode and for timing the duration of an alarm during an alarm mode. The output of the storage register 120 and an output of the binary counter 122 are applied to a full adder 124. This adder subtracts the binary output number representing ($T_r$) of the register 120 from the output of the binary counter 122. In the absence of an intrusion, the output of the full adder is zero. However, variations caused by operational factors can cause an incremental difference between the stored reference time ($T_r$) and the elapsed time ($T_e$). The adder-comparator means 126, examines the output of the adder 124 in order to sense variations between the magnitude of the elapsed time ($T_e$) and the reference time ($T_r$). If these variations exceed a predetermined increment ($\Delta T$), then an intruding condition is indicated on an output line 128 of the comparator.

As indicated, the binary counter 122 accumulates a count representative of the elapsed time ($T_e$) during an operating mode. During an initiate mode, it establishes a time delay prior to transition of the apparatus into an operating mode. In the operating mode, the counter is stepped at the clock rate ($f_c$) by the clock signal ($E_c$) which is derived from the main clock oscillator 106 and is applied to the counter 122 via a count rate control gate 130. In the initiate mode, the counter 122 is stepped by the relatively lower frequency signal ($E_s$) which is also applied via the count-rate control gate 130 to the counter 122 for stepping the counter. In the operating mode, the counter 122 is preliminarily reset by a reset pulse, ($E_r$), applied thereto on an input line 132. The count rate gate 130 is enabled by a signal on input line 133. When the transducer 22 is initially excited, counter 122 is then stepped continuously at the clock rate ($f_c$) until counting is inhibited by the receipt of a reflected acoustical pulse from a receiver means shown within the dashed rectangle and which is referenced generally as 134. A reflected acoustical signal which impinges upon the receiving transducer 30 (FIG. 1) and which is represented in FIG. 3 by the equivalent circuit of a parallel coupled crystal and inductance, causes the generation of an electrical signal which is applied to a variable gain input amplifier, 136. The amplifier 136 is a time variable gain amplifier, in which the gain of the amplifier increases with time in order to enhance the sensitivity of the apparatus and to compensate a complementary attenuation characteristic of the acoustical pulse. An output of the amplifier is applied via a control gate 138 to a receiver flip-flop 140. The received signal sets the flip-flop 140 and an output thereof is supplied via an inhibit control 142 to the counter 122 for inhibiting incrementing. The receiver flip-flop control gate 138 inhibits setting of the receiver flip-flop 140 during the pulse interval of the signal ($E_h$) to avoid cross-talk between the transmit and the receive transducers during a second transmission. A means comprising a reset gate 144 is provided for resetting the flip-flop 140 during the transmit interval ($T_h$) so that the flip-flop 140 is conditioned for sensing receipt of a reflected pulse. A main reset signal, described hereinafter, is also applied to the gate 144 for resetting the flip-flop upon initiation of operation of the apparatus. The counter inhibit control 142 disables counter incrementing upon sensing an intrusion, as indicated by a signal from an intrusion flip-flop 146 or a signal from a clock pulse enable flip-flop 148, described hereinafter.

An intrusion sensing means is provided and is shown within the dashed rectangle 149. The intrusion sensing means comprises the intrusion flip-flop 146, a gating means 150 for the flip-flop 146, an intrusion set flip-flop 152 and a gating means 154 for the flip-flop 152. The occurrence of a ($\Delta T$) greater than a predetermined value, represents an intruding condition. A signal representative of this condition is generated on the output line 128 of the comparator 126 during the time interval of the timing signal ($E_{HA}$) and is applied to the control gate 150. Timing during the interval ($T_{HA}$) is established by applying the signal ($E_{HA}$) to the comparator 126 via an input line 156. A second input to the gate 150 comprises an output of a latch enabled flip-flop 158, described hereinafter. Setting of the intrusion flip-flop 146 enables one input line to the intrusion set flip-flop gate 154. A reset pulse ($E_r$) from counter reset control 160, which occurs during the pulse interval of the signal ($E_{HB}$), sets the intrusion set flip-flop 146. An output signal ($E_i$) from this is applied to a primary counter control 162 for disabling the clock pulse incrementing of the counter 122 and for enabling relatively low rate incrementing of the counter with the signal ($E_s$) during an intrusion timer mode. The signal ($E_i$) is also applied to an alarm means 164 of the apparatus for sounding an alarm.

The alarm means shown within the dashed rectangle 164 includes an alarm horn 166, a horn driver 168, an alarm flip-flop 170 and an alarm flip-flop control 172. The alarm horn 166 is adapted to be sounded instantly upon occurrence of the output signal ($E_i$) or alternatively, to be sounded after a predetermined time delay. Instant or delayed sound of the horn upon detection of an intrustion is selectable by a switch 174. A contact 176 of the switch 174 is selectively switched to a terminal coupled to a power source 178 or alternatively, to a terminal which is coupled to ground potential. When the contact member 176 is switched to the power source terminal, the alarm means is conditioned for instantaneous sounding upon the occurrence of the signal ($E_i$). A voltage on the contact 176 is applied via a line 180 to, and enables, the alarm latch control 172. The occurrence of the signal ($E_i$) switches the alarm latch flip-flop 170 into an alarm state thereby enabling the horn driver 168 which energizes the horn 166 and sounds an alarm.

Alternatively, a delay is effected in sounding an alarm by applying to the alarm latch control 172 inputs from output terminals of the binary counter 122. Inputs to the control 172 are shown in FIG. 3 to comprise counter output terminals $Q_6$ and $Q_7$. The delayed alarm sounding state is established by switching the contact 176, of the selectable switch 174 to ground potential thereby removing an enabling potential from the control 172. Upon the occurrence of the signal ($E_i$), the counter 122 is switched to a warning mode and counts at the relatively low incrementing rate of signal ($E_s$). Under these conditions, the counter will increment relatively slowly and after a predetermined time interval elapses, output signals will appear coincidentally on counter output lines $Q_6$ and $Q_7$. At this time, the alarm latch control 172 will be enabled and the alarm latch flip-flop 170 is set thereby causing the horn 166 to be sounded.

In either the instantaneous or delayed horn sounding mode, the horn 166 will be continuously sounded as the counter 122 increments at the lower rate until an output occurs at counter terminal $Q_{12}$. The horn 166 is thus sounded for a predetermined period. Coincidence between a signal at counter terminal $Q_{12}$ and the intrusion set signal ($E_i$) is sensed by a main reset gate 181 to which these signal are applied. An output from this gate upon occurrence of a signal at terminal $Q_{12}$ is applied to a main reset control 184 which generates a main reset pulse ($E_R$) on output line 192. The main reset pulse resets all registers, terminates energization of the horn 166 and initiates a start-up mode for the apparatus.

An apparatus control means shown within the dashed rectangle 182 includes the main reset control 184, a sequence flip-flop 186 and the clock pulse enable flip-flop 148. An output of the flip-flop 148 which is applied to the count input primary control 162 causes an output signal on an output line 133 thereof. This signal enables the clock rate control 130 to transmit the clock rate signal ($E_c$) to the counter 122 for incrementing the counter at the clock rate. An exemplary clock rate is 24 KHz. When the clock pulse enable flip-flop 148 is reset, a signal on the output line 133 of the count input primary control 162 enables the count rate control 130 to transmit the signal ($E_s$) and to increment the counter 122 at the relatively slower rate. An exemplary slower rate is 6 Hz.

The application of operating potential to the apparatus through an on-off switch 190 (when the switch contact 176 is connected to ground potential) causes the main reset control 184 to momentarily generate a main reset pulse ($E_R$) on an output line 192. This pulse resets all flip-flops and registers in the apparatus conditioning the apparatus for an initial mode of operation. The main reset pulse ($E_R$) is applied to and resets the sequence flip-flop 186 and the clock pulse enable flip-flop 148. Since the sequence flip-flop 186 is reset, a clock pulse enable control gate 194 is disabled and inhibits the signal ($E_{HB}$) from setting the clock pulse enable flip-flop 148. Under these conditions, the count input primary control 162 causes the count rate control 130 to enable transmission of the lower frequency signal ($E_s$) and to increment the counter 122 at the relatively lower rate. As the counter increments at this lower rate, a predetermined interval of time ($T_D$) will elapse before the counter accumulates a count for establishing an output signal at a terminal $Q_9$ thereof.

This interval of time ($T_D$) is selected to provide a desired period of time after initiation of operation of the apparatus for enabling the user to exit the area to be protected. Thus there is provided a period of time within which the user can set up the apparatus and leave the protected area without false alarms being triggered by his temporary presence during start-up.

At the termination of this interval ($T_D$), an output signal occurring on the counter line $Q_9$ is applied to a delay control gate 196, which causes the sequence flip-flop 186 to enable gate 194. Upon the occurrence of the next succeeding timing signal ($E_{HB}$), at gate 194, the clock pulse enable flip-flop 148 is set. A set output from flip-flop 148 causes the count input primary control 162 to establish a voltage on its output line 133 for enabling the count rate control 130 to transmit the clock signal ($E_c$) and increment the counter at the clock rate. The timing signal ($E_{HB}$) which is also applied to the counter reset control 160, simultaneously resets the counter 122.

Alternative to the described delayed mode of start-up, a selection of instant start-up is provided by actuation of the switch member 176 of the switch 174 to the terminal coupled to the power supply 178. This causes the gate 196 to be enabled, thus setting the sequence flip-flop 186 and initially causing stepping of the counter 122 at the relatively higher clock rate.

An advantageous feature of the intrusion alarm apparatus is automatic ranging of the reference surface 24 (FIG. 1). Initial incrementing of the counter 122 is timed by the pulse signal ($E_{HB}$) which sets the flip-flop 148 and by the count input primary control 162 which, responsive to flip-flop 148, enables the count rate control gate 130 to transmit clock rate pulses. There occurs simultaneously in time with the signal ($E_{HB}$), the previously described transmitter transducer gate signal ($E_{HBC}$). An acoustical signal is generated and projected as the counter 122 initiates its count. The acoustical signal is projected toward the reference surface 24, and will be reflected therefrom. Upon sensing of the reflected energy by the receiving transducer 30 at some point during an interval ($T_S$) between a receiver blocking interval ($T_h$) and a subsequent receiver blocking interval ($T'_h$), the receiver flip-flop 140 will be set and inhibit further incrementing of the counter 122 as described hereinbefore. Output terminals of the counter 122 are also coupled to input terminals of the storage register 120 by a bus line 199 and the accumulated count is applied to the storage register 120. Upon occurrence of the next successive timing signal ($E_{HA}$), a latch flip-flop control gate 198 is enabled thereby setting the latch enable flip-flop 158. An output of this gate is applied via input line 200 to the storage register, thereby latching the register and storing the initial count of the binary counter 122 in this register. This initially stored count, in the form of an electrical signal at output terminals 201 of the register 120, comprises a reference parameter ($T_R$) having a magnitude representative of an interval of time elapsed during unimpeded projection and reflection of an initial acoustical pulse between the transmitting transducer 22 and the receiving transducer 30. This count ($T_R$) remains stored by the register 120 until the latch enable flip-flop 158 is reset upon the occurrence of a main reset pulse. Main reset occurs automatically when the binary counter 122 accumulates a count $Q_{12}$ and the alarm flip-flop for 170 is set. After an initial cycle of operation, the contents of the storage register 120 and the counter 122 are essentially the same and the output of the full adder is essentially zero. The adder comparator is preset to some predetermined number representative of a ($\Delta T$) in order to accommodate some difference between ($T_R$) and ($T_e$) resulting from various operational factors such as design tolerances, etc. The output of the comparator 126 is accordingly effectively zero during the time interval ($T_{HA}$) of the next occurring timing signal ($E_{HA}$). After the next signal ($E_{HBC}$) and the projection of a pulse of acoustical energy, the counter 122 will increment and the elapsed time ($T_E$) between the projection and the reflection of the pulse is stored in the counter 122. The contents of the storage register 120 representing ($T_R$) and of the counter 122 representing ($T_E$) are thereafter compared during the next time interval ($T_{HA}$). If the difference between ($T_R$) and ($T_e$) is less than a predetermined increment ($\Delta T$), an intrusion is not indicated and an intrusion output signal is not generated on line 128.

Figure 6:
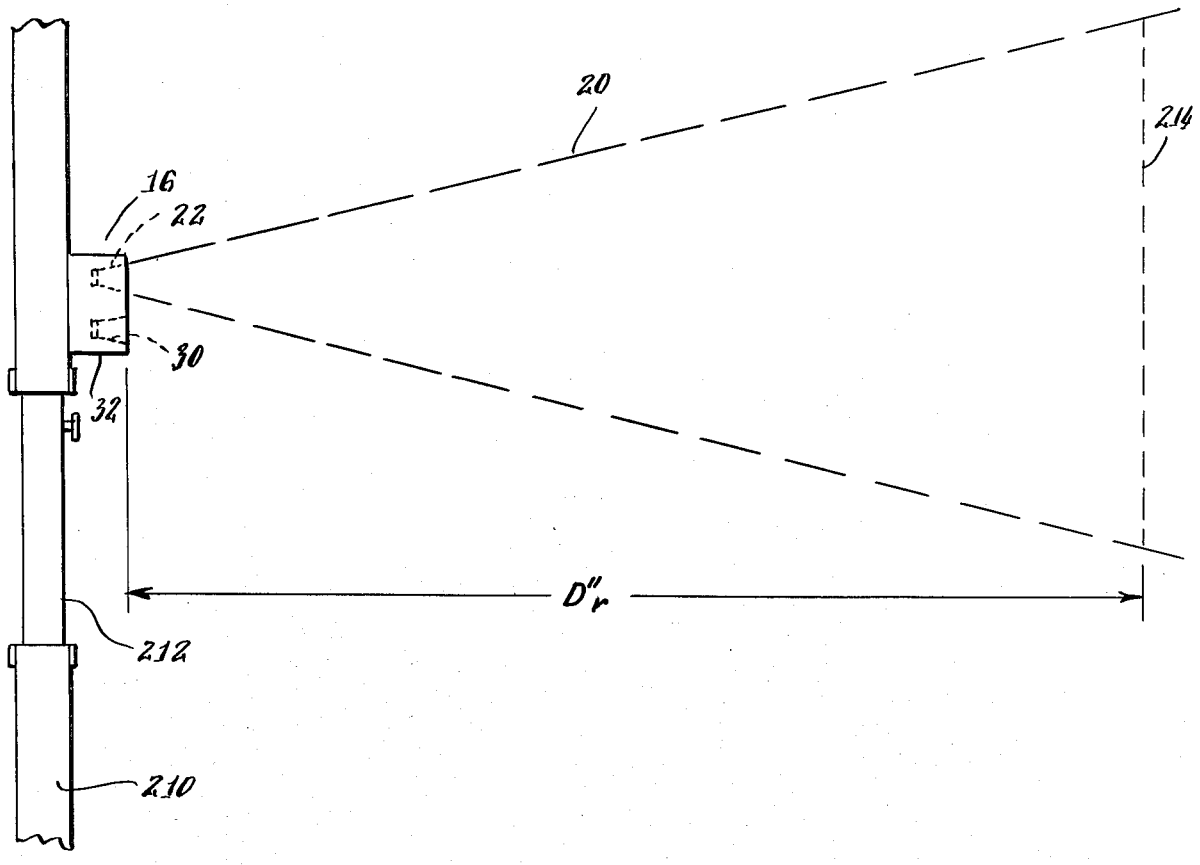
FIG. 6 is a fragmentary, schematic plan view illustrating an alternative use of the method and apparatus of the invention.

The apparatus of the present invention is further useful with respect to detecting intrusions in a protected area when an inadequate reference surface is provided or when no reference surface exists. A particular application under these circumstances is found, for example, in detecting the presence of objects or parties about or approaching an exterior door. In FIG. 6, a fragmentary section of an exterior building wall 210 is illustrated having an entrance door 212. The apparatus 16 is mounted adjacent to the door at a convenient elevation and projects the conical beam 20 in a direction outwardly from the wall and the door. It will be noted that a reference surface does not exist within the range ($D''_R$) of the apparatus. The dashed line 214 indicates the outer extremity of the cone 20 at the range ($D''_R$). Under these circumstances, and in the absence of an object within the cone between the source 16 and the line 214, there will be no reflection of projected acoustical energy nor will an input signal be generated by the receiver means 134 of FIG. 3. The binary counter 122 will therefore continue to step until occurrence of a succeeding signal ($E_{HA}$) at which time an accumulated count in counter 122 will be transferred to the storage register 120 after the initial count. The counter 122 has a count capacity so that at the clock rate ($f_c$) its capacity exceeds the number of counts which can be accumulated between successively occurring pulses ($E_{HA}$). For example, at a ($E_{HA}$) pulse repetition rate of approximately 12 Hz (T=83 ms) and a counter stepping rate of 24 KHz, approximately 1999 counts will be accumulated between successive ($E_{HA}$) pulses. The counter 122 is a twelve bit counter which has a capacity of 2096 counts which is a greater number of counts than can be accumulated in 83 ms. An accumulated count at the termination of an initial 83 ms (ie. 1999) will be transferred to the storage register 120 and established as the reference count ($T_R$). This count represents an "effective" reference surface established at the location 214 (FIG. 6). When an object or party enters the beam 20 and causes a reflection therefrom at a location between the apparatus 16 and the location 214, a variation between the stored count and the count corresponding to the reflection from the distance 214 will be provided and an alarm will be sounded as indicated before. Although as indicated hereinbefore, the remote human body will not efficiently reflect acoustical energy, the movement of a body to a more proximate location with respect to the apparatus 16 will increase the efficiency until a point is reached at which detection will be provided.

Figure 5:
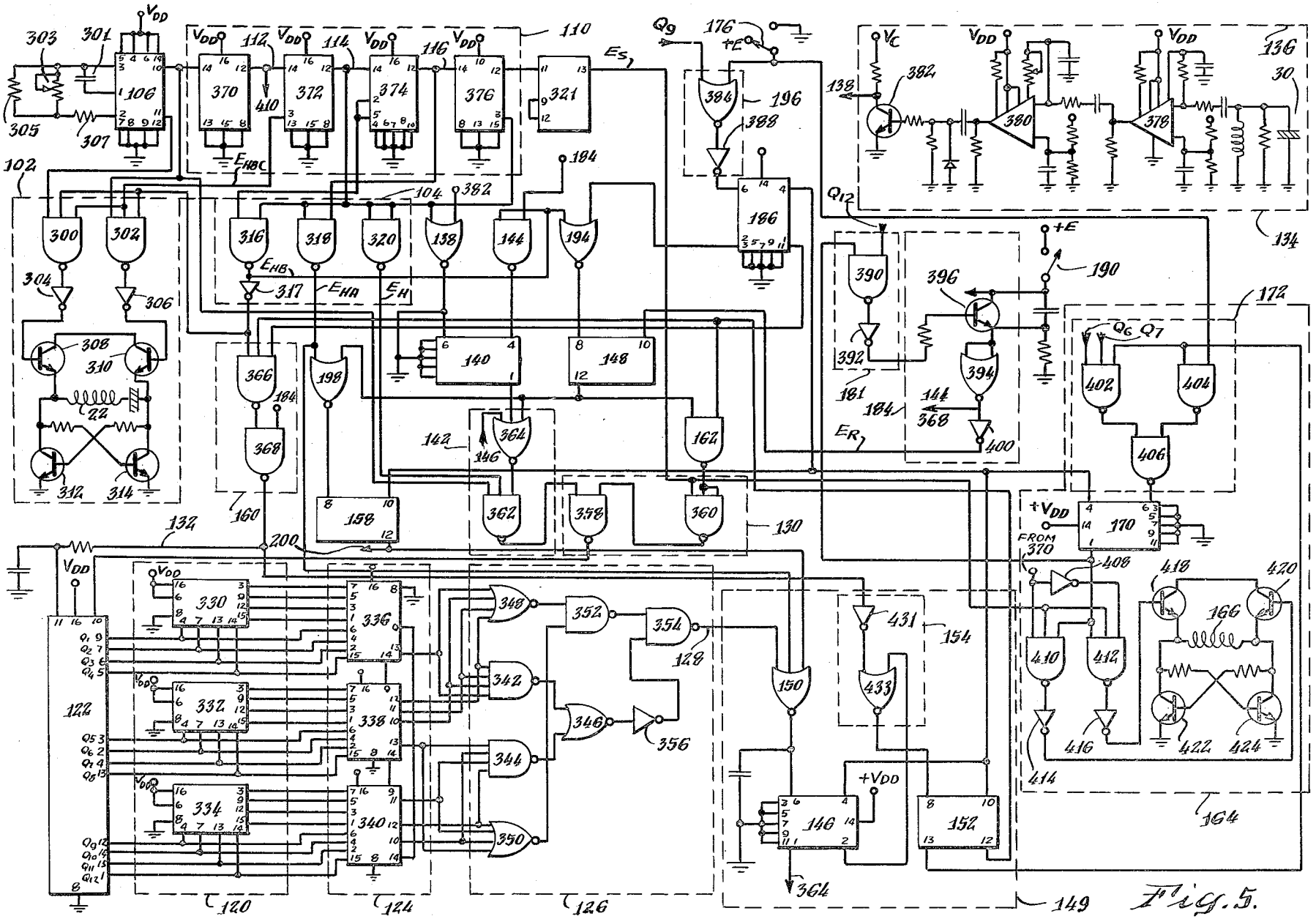
FIG. 5 is a more detailed schematic diagram of the apparatus of FIG. 3.

A more detailed representation of the arrangement of FIG. 3 is illustrated in FIG. 5. Those elements of FIG. 3 which, as shown in FIG. 5 are formed of a plurality of logic elements, are enclosed within dashed rectangles and are indentified by the same reference numerals as used in FIG. 3. Those elements of FIG. 3 whose function is performed by a single logic element bear the same reference numerals in FIG. 5. The transducer circuit 102 of the transmitter 100 includes first and second NAND gates 300 and 302 which are coupled by inverter amplifiers 304 and 306 to base electrodes of NPN transistor amplifiers 308 and 310 respectively. The latter amplifiers along with NPN transistor amplifiers 312 and 314 are intercoupled in a totem pole circuit arrangement for periodically exiciting the transducer 22 at the clock frequency (f) during the limited interval ($T_{HBC}$).

Oscillator 106 comprises a free running multivibrator having a capacitance 301 and resistances 303, 305 and 307 for establishing a desired operating frequency. In an exemplary arrangement, the oscillator operates at a frequency of 24 KHz. An output of oscillator 106 is applied to a first decade counter 370 of the clock distributor stage 110. This distributor stage also includes decade counters 372 and 376 as well as one-half section of a dual D flip-flop 374. For an exemplary clock frequency of 24 KHz, the outputs at terminals of the decade counter units 370 and 372, of the flip-flop 374 and of the decade counter 376 occur at a frequency of 2.4 KHz, 240 Hz, 120 Hz, and 12 Hz respectively. The outputs are applied to the system timing stage 104. This stage includes NAND gate 316 and an inverting amplifier 317, the NAND gates 318 and 320 all of which are shown in the rectangle 104, and, in addition, a dual D flip-flop 321 which for convenience in the layout of the drawing is shown outside of the rectangle 104.

The counter rate control 130 for applying stepping pulses to the counter 122 comprises the NAND gate 358 and 360. Inhibit control 142 for inhibiting counter incrementing is provided by a NOR gate 364 and a NAND gate 362. The counter 122 comprises a 12 stage binary counter whose outputs Q1 through Q12 are coupled to the storage register 120 and to the full adder 124. The storage register 120 is provided by three, quad, clock latches 330, 332 and 334 each providing four bits of storage. A latch signal is derived from flip-flop 158 on line 200 and is coupled to each of these latches. For purposes of simplifying the drawing the coupling of latch control line 200 to the latches is not shown. The full adder 124 comprises a twelve bit full adder formed by three, four-bit, full adders 336, 338 and 340. Outputs of these stages are coupled to the adder comparator 126 which includes NAND gates 342 and 344. Outputs of the latter NAND gates are applied to a NOR gate 346. Outputs of the adder comparator stages are also coupled to NOR gates 348 and 350. Outputs of these NOR gates are applied to a NAND gate 352. The NAND gate 352 signal along with the output signal of the NOR gate 346 are applied directly and via an inverter amplifier 356 respectively to the NAND gate 354.

A signal on the line 128 is applied to the intrusion sensing flip-flop NOR gate control 150. The intrusion flip-flop 146 and the intrusion set flip-flop 152 comprise one-half sections of dual D flip-flops. The gate control 154 is provided by an inverting amplifier 431 and by a NOR gate 433.

Sequence flip-flop 186, clock pulse enable flip-flop 148 and latch enable flip-flop 158 of the apparatus control means 182, each comprise one-half of a dual D flip-flop. The control gate 196 associated with flip-flop 186 is provided by a NOR gate 384 and an inverter amplifier 388. The gates 194 and 198 associated with the flip-flops 148 and 158 respectively comprise NOR gates. Counter reset control 160 is provided by a NAND gate 366, the output of which is coupled to another NAND gate 368 along with a reset pulse ($E_R$) from the main reset control 184. Reset gate 181 is shown to comprise a NAND gate 390 and an inverter amplifier 392. The output of this amplifier is coupled to the main reset control 184 at a base electrode of a transistor 396. ON-OFF switch 190 applies collector voltage to the transistor 396 and supplies operating voltages $D_{cc}$ to components of the apparatus. An emitter electrode of the transistor 396 is coupled to a NOR gate 394. One output of this gate is coupled to an inverter amplifier 400 for distributing a reset pulse ($E_R$) to various registers. Another output of the NOR gate 394 is applied to the NAND gate 144 for resetting the receiver flip-flop 140 and to the NAND gate 368 for resetting the counter 122 as indicated. Selection of a delayed mode of operation is provided by switching the contact arm 176, which is coupled to an input of the NOR gate 384 of the delay control gate 196, and to a NAND gate 404 of the alarm flip-flop control 172.

The alarm flip-flop control 172 of the alarm control circuit 164 is provided by NAND gates 402 and 404 each of which are coupled to a NAND gate 406. An output of the NAND gate 406 is applied to a dual D alarm flip-flop 170. The alarm horn driver circuit arrangement 168 includes NAND gates 410 and 412, the output of which are coupled by inverter amplifiers 414 and 416 respectively to a totem pole transistor driver arrangement including NPN transistors 418, 420, 422 and 424. The horn 166 is represented as a coil in FIG. 5. Inputs to the NAND gates 410 and 412 include a signal at the reduced frequency of 2.4 KHz which is derived from an output of the decade counter 370 of the clock distributor stage 110. An inverter amplifier 408 couples this input to the NAND gate 412.

An electrical signal from the acoustical transducer 30 of the receiver means 134 is applied to an operational variable gain amplifier 378. The signal thus received is amplified and is coupled in tandem to an operational amplifier 380 and to a pulse amplifier 382 wherein the amplified received acoustical signal is provided as an electrical output pulse. This pulse is applied to the NOR gate 138 for setting a dual D receiver flip-flop 140. The receiver flip-flop 140 is reset by an output pulse from the reset NAND gate 144.

Each of the logic elements of FIG. 5 are well known commercially available elements. In an ememplary arrangement not deemed to be limiting of the invention in any respect, the following commercially available components identified by their component specification numbers have been utilized successfully in the preferred embodiment of FIG. 5. FIG. 5 illustrates the terminal numbers for particular register components listed.

| Component | CMOS Specification No. |
|---|---|
| Multivibrator 106 | 4047 |
| Decade Counters 370, 372, 376 | 4017 |
| Flip-Flops 374, 32, 140, 148, 158, 186, 146, 152, 170 | 4013 |
| Binary Counter 122 | 4040 |
| Quad Clocked Latches 330, 332, 334 | 4042 |
| Full Adders 336, 338, 340 | 4008 |
| NAND Gates | 4011 |
| | 4023 |
| | 4012 |
| NOR Gates | 4001 |
| | 4002 |
| Inventor Amplifiers | 4009 |
| Operation Amplifiers | CA 3094 |
| Pulse Amplifier 382 | 2N 5210 |

An improved method and apparatus for intrusion detection has thus been described. The method and apparatus are advantageous in that they provide for pulse echo intrusion detection having reduced susceptibility to false alarms. The intrusion detection arrangement advantageously provides for automatic ranging of a reference surface, and means providing a start-up delay, operational counting, alarm period counting and automatic termination. The apparatus of the invention is advantageous in that it is relatively compact and lends itself to production techniques at relatively low cost.

While there has been described a particular embodiment of the invention, it will be apparent to those skilled in the art that variations may be made thereto without departing from the spirit of the invention and the scope of the appended claims.

What is claimed is:

1. An improved method for detecting the presence of an intruding object or certain other environmental changes in a protected area, the method comprising the steps of:

(a) projecting a reference pulse of acoustical energy from a source into an area towards a reflective surface therein, (b) establishing a reference parameter ($T_r$) having a magnitude proportional to the interval of time elapsed between projection of said reference pulse and reflection of said reference pulse to a receiver, (c) projecting a similar pulse of acoustical energy from the source towards the reflective surface, (d) establishing an elapsed time parameter ($T_e$) having a magnitude proportional to the interval of time elapsed between projection of said similar pulse and reflection of said similar pulse to the receiver, (e) comparing the magnitude of the elapsed time parameter ($T_e$) with the magnitude of the reference parameter ($T_r$) and sensing for a variation ($\Delta T$) therebetween, and (f) generating an alarm in response to a variation ($\Delta T$).

2. The method of claim 1 wherein said alarm is generated when the magnitude of said variation ($\Delta T$) exceeds a predetermined magnitude.

3. The method of claim 2 wherein said alarm is generated for a predetermined interval of time and is terminated upon expiration of said interval of time.

4. The method of claim 3 wherein said steps (a) through (f) are repeated upon termination of said alarm.

5. The method of claim 1 wherein said reference parameter ($T_r$) comprises a first digital electrical signal, said elapsed interval of time ($T_e$) is represented by a second digital electrical signal and said first and second digital electrical signals are compared.

6. The method of claim 5 wherein said digital first electrical signal is automatically established by periodically incrementing a binary counter during an interval of time and transferring a count accumulated by said counter to a storage register, said second electrical signal is established by incrementing a binary counter over an interval of time, and said comparison is provided by comparing the contents of said counter and said storage register.

7. The method of claim 6 including incrementing said counter at a first rate for a predetermined interval of time and subsequently incrementing said counter at a second relatively greater rate.

8. The method of claim 7 including incrementing said counter at said first rate for a predetermined interval of time when said variation $\Delta T$ exceeds said predetermined magnitude time and generating said alarm for said predetermined interval of time.

9. An improved apparatus for detecting the presence of an intruding object or certain other environmental changes in a protected area, the apparatus comprising:

(a) source means for periodically projecting a pulse of acoustical energy into an area having at least one reflective surface therein, (b) receiver means for sensing reflection of the pulses of acoustical energy, (c) sensing and comparison means coupled to said source means and said receiver means for:

(1) sensing the elapsed time between the projection of each pulse by said source means and reception of the reflection thereof by said receiver means, (2) establishing a reference parameter ($T_r$) having a magnitude proportional to the elapsed time between projection and reception of an initial pulse, (3) comparing the reference parameter ($T_r$) with an elapsed time parameter ($T_e$) having a magnitude proportional to the elapsed time between projection and reception of a subsequent pulse and sensing for a variation ($\Delta T$) therebetween, and (4) producing an output signal in response to a variation ($\Delta T$), and (d) alarm means coupled to said sensing and comparison means for receiving output signals therefrom, said alarm means generating an alarm in response to an output signal from said sensing and comparison means.

10. The apparatus of claim 9 wherein said sensing and comparison means comprises digital circuit counter means for accumulating a count representative of the elapsed time interval, digital signal storage means for storing a digital signal, means operative in response to the initial pulse for transferring a digital signal ($T_r$) from said counter means to said storage means, and means for periodically comparing the magnitude of a digital signal stored in said storage means ($T_r$) and digital signal ($T_e$) accumulated in said counter means.

11. The apparatus of claim 10 wherein said sensing and comparison means further comprises an adder coupled to said storage means and to said counter means for providing a signal representative of the difference in magnitude between digital signals stored by said storage and counter means, and means for comparing an output of said adder with a digital signal representative of a predetermined variation.

12. The apparatus of claim 11, including means for causing said counter means to increment at a first rate during a start-up mode and to increment at a second relatively greater rate during an operating mode.

13. The apparatus of claim 12 including means for causing said counter means to increment at said first rate for a predetermined period of time when said predetermined variation of magnitude occurs and for generating said alarm during said predetermined period of time.

14. The apparatus of claim 13 including means for delaying the generation of said alarm until said counter, incrementing at said relatively lower rate, has accumulated a predetermined delay count.

* * * * *